United States Patent [19]

Koide et al.

[11] Patent Number: 4,530,187

[45] Date of Patent: Jul. 23, 1985

[54] DRESSING DEVICE FOR GRINDING WHEELS

[75] Inventors: Tsuyoshi Koide, Toyota; Toshio Maruyama, Kariya, both of Japan

[73] Assignee: Toyoda Koki Kabushiki Kaisha, Kariya, Japan

[21] Appl. No.: 519,719

[22] Filed: Aug. 2, 1983

[30] Foreign Application Priority Data

Aug. 31, 1982 [JP] Japan ..... 57-151427

[51] Int. Cl.[3] ..... B24B 53/14

[52] U.S. Cl. ..... 51/165.87; 125/11 CD

[58] Field of Search ..... 51/165.87, 165.88; 125/11 R, 11 CD

[56] References Cited

U.S. PATENT DOCUMENTS

| | | | |
|---|---|---|---|
| 3,782,046 | 1/1974 | Schaap | 51/165.87 |
| 3,791,084 | 2/1974 | Kakumu | 51/165.87 |
| 3,828,477 | 8/1974 | Sanford | 51/165.87 |
| 3,928,943 | 12/1975 | Wirz | 51/165.87 |
| 4,359,841 | 11/1982 | Barth | 51/165.87 |

FOREIGN PATENT DOCUMENTS

| | | | |
|---|---|---|---|
| 531718 | 10/1976 | U.S.S.R. | 51/165.87 |

*Primary Examiner*—Harold D. Whitehead

*Attorney, Agent, or Firm*—Oblon, Fisher, Spivak, McClelland & Maier

[57] ABSTRACT

A dressing device for a grinding wheel comprises a wheel head for supporting the grinding wheel in a manner adapted for grinding the outer surface of a workpiece; a dressing tool provided to cut into the grinding wheel for dressing the same; a feed motor to feed the dressing tool so as to cut into the grinding wheel; a device for detecting the diameter of the grinding wheel; and a control device which controls the feed motor in response to the output of the detecting device so that the depth of the cut caused by the dressing tool is controlled in accordance with the diameter of the grinding wheel.

4 Claims, 5 Drawing Figures

DRESSING DEVICE FOR GRINDING WHEELS

BACKGROUND OF THE INVENTION

This invention relates to a device for dressing grinding wheels which grind outer surfaces of workpieces.

In a grinding machine having a grinding wheel, abrasive grains on the surface of the grinding wheel tend to be lost during the grinding operation, thus reducing the capability of cutting the surface of a workpiece. For recovering the capability, the operative surface of the grinding wheel must be dressed periodically.

For instance, in a grinding machine for grinding a plurality of cams on a cam shaft, it is an ordinary practice that, each time when a predetermined number of cams are ground, the grinding wheel is corrected or dressed by removing a predetermined depth from the surface of the grinding wheel.

However, the condition of the surface of the grinding wheel to be dressed is not always same, but is varied depending on its diameter. When the diameter of the grinding wheel is large, the reduction or deterioration of the abrasive property of the grinding wheel is comparatively small. However, when the diameter of the grinding wheel is reduced, the reduction of the abrasive property of the wheel becomes significant. The reason for this is considered that when the diameter of a grinding wheel is small, the number of abrasive grains on the surface is also small, and hence the amount of work to be accomplished by one grain increases when the entire grinding wheel carries out a predetermined amount of work. Thus, the time interval or separation between successive dressings carried out on the grinding wheel is determined based on that having a minimum operable diameter, the surface condition of which is deteriorated in a shortest period. In this case, however, since the grinding wheel of a larger diameter is dressed in a comparatively short period regardless of the surface condition remaining a sufficient capability of grinding, there arises a difficulty of wasting the precious material of the grinding wheel and shortening the operational life of the same.

For obviating the above described difficulty, there has been proposed another procedure wherein the dressing time interval is varied in accordance with the diameter of the grinding wheel. For instance, when the diameter of a grinding wheel is still large, the time interval is so selected that the dressing is carried out every $(n+1)$ workpieces ground, whereas when the diameter of the grinding wheel is reduced, the dressing is carried out every n or $(n-1)$ workpieces having been ground by the grinding wheel. Such a procedure, however, has been found disadvantageous for a case where a plurality of cams on a cam shaft are successively ground by a grinding wheel which is to be dressed in the course of a grinding cycle, because a remarkable difference in the surface structure tends to be exhibited on the cams on the cam shaft.

SUMMARY OF THE INVENTION

An object of the present invention is to provide a dressing device for a grinding wheel, capable to correct the surface of the grinding wheel effectively without varying the dressing time interval.

Another object of the invention is to provide a dressing device for a grinding wheel, wherein the depth of cut by a dressing tool is increased in accordance with the decrease of the diameter of the grinding wheel, so that the dressing operation is performed with a minimum amount of the abrasive material required to be removed in accordance with the deterioration of the surface condition, and the operational life of the grinding wheel is thereby increased.

These and other objects of the present invention can be achieved by a dressing device for a grinding wheel, which comprises a wheel head for supporting the grinding wheel in a manner suitable for grinding outer surface of a workpiece; a dressing tool provided to cut into the grinding wheel for dressing the same; a feed motor to feed the dressing tool so as to cut the grinding wheel; means for detecting diameter of the grinding wheel; and a control device which controls the feed motor in response to the output of the detecting means so that the dressing tool is fed to cut the grinding wheel by an amount increased in accordance with a decrease in diameter of the grinding wheel.

The control device for the feed motor may be so constructed that it includes a plurality of digital switches each setting stepwisely a depth of cut to be realized by the dressing tool in accordance with the diameter of the grinding wheel, and it selects one of the digital switches in response to the output of the detecting means for controlling the feed motor so as to realize the depth of cut set by the digital switch thus selected.

DESCRIPTION OF THE PREFERRED EMBODIMENT

Figure 1:
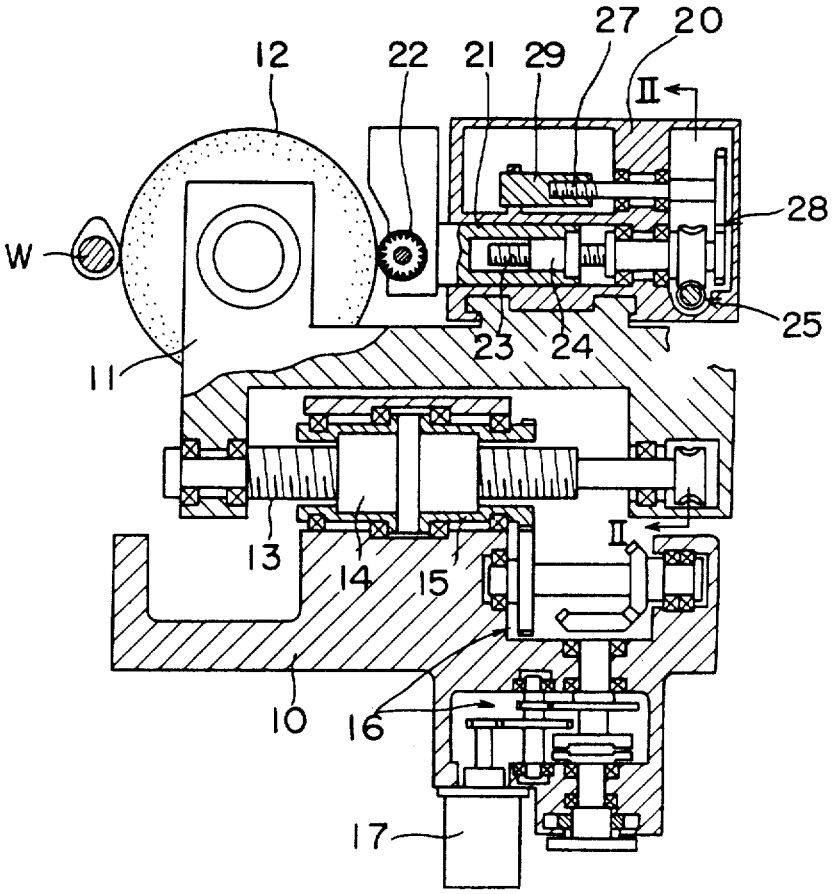
FIG. 1 is a sectional view showing a general construction of a preferred embodiment of the present invention.
Figure 2:
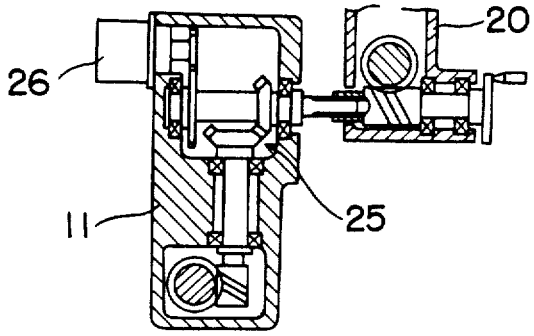
FIG. 2 is a sectional view taken along the line II—II in FIG. 1.

Apreferred embodiment of the present invention will now be described in detail with reference to the accompanying drawings. In FIGS. 1 and 2 showing an example wherein the invention is applied to a cam grinder, a grinding wheel 12 driven by an electric motor (not shown) is rotatably supported by a wheel head 11 which is slidably mounted on a bed 10 of the cam grinder. A feed screw 13 provided in the wheel head 11 is rotatable around its axis extending in parallel with the sliding direction of the wheel head 11. A nut 14 engaging with the feed screw 13 is fixed to a sleeve 15 which in turn is secured to the bed 10 in such a manner that the sleeve 15 is only rotatable around its longitudinal axis. An electric motor 17 is coupled through a gear mechanism 16 to the sleeve 15 for feeding the wheel head 11 toward a workpiece W.

On the wheel head 11 is mounted a traverse block 20 which is slidable in parallel with the rotating axis of the grinding wheel 12. The traverse block 20 includes a ram 21 slidable in a direction perpendicular to the sliding direction of the traverse block 20. A diamond roller 22 rotated by an electric motor (not shown) is rotatably mounted on an end of the ram 21. The traverse block 20 further includes a feed screw 23 which is rotated by an electric motor 26 through a gear mechanism 25. A nut 24 engaging the feed screw 23 is secured to the ram 21. When the feed screw 23 is rotated by the electric motor 26, the ram 21 and hence the diamond roller 22 is shifted toward the grinding wheel 12 for dressing the same. The gear mechanism 25 is further coupled with the first mentioned feed screw 13 such that the screw 13 rotated in connection with the cutting operation of the diamond roller 22 serves to correct the position of the wheel head 11 by an amount corresponding to the cutting depth of the diamond roller 22.

Figure 3:
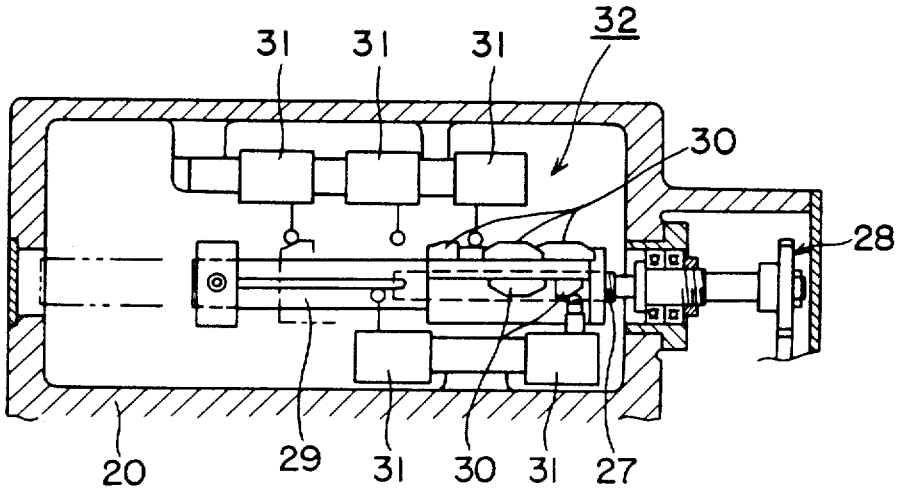
FIG. 3 is a sectional view showing in detail a detecting device used in the present invention for detecting the diameter of a grinding wheel.

In the traverse block 20, there is provided a screw thread shaft 27 rotatable around its center line extending in parallel with the feed screw 23. One end of the shaft 27 is coupled with the feed screw 23. The screw thread shaft 27 is in engagement with a diameter detecting shaft 29, as shown in FIG. 3, which is supported within the traverse block 20 to be movable in the axial direction. A plurality of dogs 30 are attached to the detecting shaft 29. The dogs 30 actuate a plurality of limit switches 31 also included in the traverse block 20. The spaces between the limit switches 31 and the corresponding dogs 30 are made different from each other, so that the sliding movement of the detecting shaft 29 sequentially operates the limit switches 31.

Figure 4:
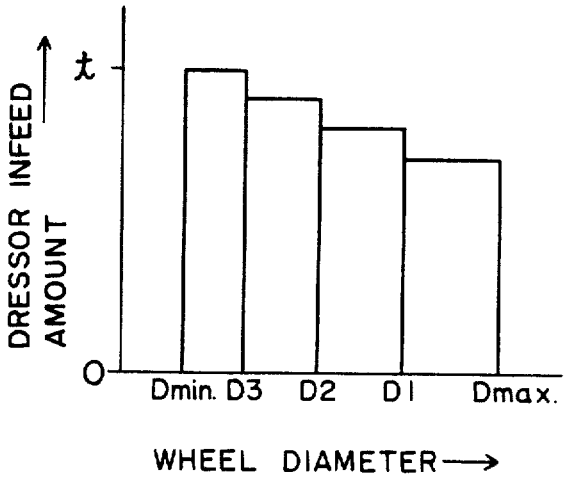
FIG. 4 is a diagram showing the relation between the diameter of the grinding wheel and the cutting depth of the dressing tool.

Thus when the screw thread shaft 27 is rotated in connection with the rotation of the feed screw 23 (or cutting operation of the diamond roller 22), the detecting shaft 29 is shifted axially and the diameter of the grinding wheel 12 is detected from the operations of the limit switches 31. In the shown example, five sets of the dogs 30 and the limit switches 31 are utilized, and hence the diameter of the grinding wheel 12 in the operable range of the maximum diameter $D_{max}$ to the minimum diameter $D_{min}$ can be detected in four stages as shown in FIG. 4. The combination of the above described screw thread shaft 27, diameter detecting shaft 29, dogs 30 and the limit switches 31 constitute a diameter detecting device 32 of the grinding wheel 12.

Figure 5:
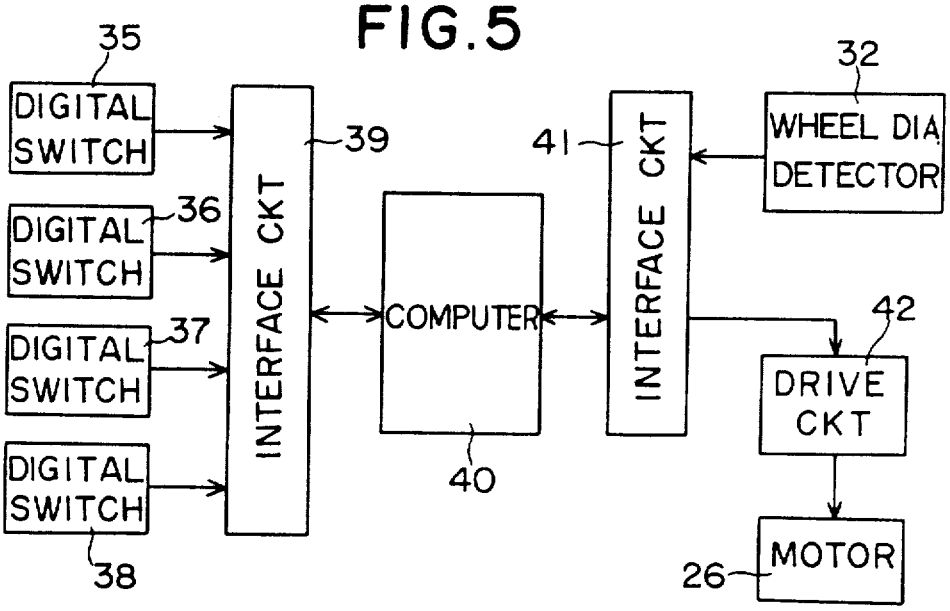
FIG. 5 is a block diagram showing a control circuit for controlling the cutting depth of the dressing tool.

The cutting depths of the diamond roller 22 are beforehand determined for the four diametrical stages of the grinding wheel 12, respectively. For instance, when the cutting depth corresponding to the lowest stage from the minimum diameter $D_{min}$ to a diameter $D_3$ is assumed to be t, the cutting depth corresponding to the subsequent stage between diameters $D_3$ and $D_2$ is determined to be 0.9t, the cutting depth of the next following stage between diameters $D_2$ and $D_1$ is determined to be 0.8t, and the cutting depth of the highest stage between diameters $D_1$ and $D_{max}$ is determined to be 0.7t. These values of the cutting depths are beforehand memorized in four digital switches 35 through 38 in FIG. 5, respectively. The digital switches 35–38 are connected with a computer 40 through an interface 39. The output signals of the aforementioned diameter detecting device 32 are supplied through another interface 41 to the computer 40. The computer 40 discriminates the diameter of the grinding wheel 12 based on the output signals from the detecting device 32. The computer 40 further reads out one of the memorized values in the digital switches 35–38 which corresponds to the discriminated value of the diameter, and applies pulses of a number corresponding to the read out value to the driving circuit 42 of the electric motor 26 through the interface 41.

In this example, the workpiece W is a cam shaft having a plurality of cams. The cam shaft W is supported on an oscillating support pivotally mounted on an index table provided on the bed 10 of the cam grinder. When the oscillating support is moved to profile a master cam, one of the cams on the cam shaft is ground as desired.

Since the device of the present invention is constructed as described above, the wheel stand 11 is moved forward in accordance with the rotation of the nut 14 caused by the electric motor 17, and a cam on the cam shaft W on the oscillating support is ground in accordance with the profiling movement of the support. Upon completion of the grinding operation of a cam, the table is indexed such that the subsequent cam is brought into the opposing position to the grinding wheel 12. The above described operation is repeated until the entire cams on the cam shaft are ground.

During the above described grinding operation of the cam shaft, a dressing instruction is issued after completion of, for instance, every two cams. With this instruction, the grinding wheel 12 is dressed by the diamond roller 22, the cutting depth of which is beforehand selected by the electric motor 26 in accordance with the diameter of the grinding wheel 12. More specifically, the computer 40 judging the diameter range of the grinding wheel 12 based on the output signals from the diameter detecting device 32, reads out a set value in the digital switches 35–38, and supplies pulses of a number corresponding to the set value to the driving circuit 42 of the electric motor 26. The electric motor 26 thus shifts the diamond roller 22 toward the grinding wheel 12 by an amount corresponding to the cutting depth determined in accordance with the diameter of the grinding wheel 12. The dressing operation of the grinding wheel 12 is thus accomplished by a traverse movement of the traverse block 20. In this case, the feed screw 13 interlinked with the forward shift of the diamond roller 22 is rotated to shift the wheel stand 11 toward the cam shaft W by an amount corresponding to the cutting operation of the diamond roller 22. Simultaneously, the diameter detecting shaft 29 is also shifted in a manner interlinked with the cutting operation of the diamond roller 22.

In case where the diameter of the grinding wheel 12 is reduced as a result of the dressing operation, and the operational condition of the limit switches 31 and the dogs 30 on the detecting shaft 29 is thereby varied, the output signal delivered from the diameter detecting device 32 to the computer 40 is thereby varied, thus changing the control of the subsequent dressing operation so as to increase the cutting depth of the diamond roller 22.

According to the present invention, the fact that the surface deterioration of a grinding wheel varies in accordance with the diameter of the grinding wheel is taken into consideration, and the dressing is carried out in such a manner that the diameter of the grinding wheel is determined firstly, and then the cutting depth of the dressing tool is reduced when the diameter thus determined is large, or the cutting depth of the dressing tool is increased when the diameter is small. As a consequence, the cutting depth of the dressing tool and hence the removed amount of the grinding wheel can be maintained at a minimum value, thus enabling an optimum control of the cutting depth in accordance with the surface condition of the grinding wheel and lengthening the operational life of the grinding wheel.

Furthermore, since the improvement of the operational life and the economy of the grinding wheel can be realized without changing the time interval between the dressing operations, the application of the invention to the cam shaft having a plurality of cams can be much facilitated.

Obviously, numerous modifications and variations are possible in light of the above teachings. It is therefore to be understood that within the scope of the appended calims, the invention may be practiced otherwise than as specifically described herein.

We claim:

1. A dressing device for a grinding wheel rotatably supported on a wheel head of a grinding machine, comprising:

a tool support movable toward the outer surface of said grinding wheel;

a dressing tool carried on said tool support for dressing said grinding wheel;

feed means connected to said tool support for moving said tool support toward said grinding wheel so as to bring said dressing tool into engagement with said grinding wheel;

detection means for detecting the diameter of said grinding wheel and producing an output signal; and a control means connected to said feed means and responsive to said output signal from said detection means for controlling said feed means in such a manner such that the cutting depth of said dressing tool into said grinding wheel in each dressing operation is progressively increased in connection with a decrease in the diameter of said grinding wheel.

2. A dressing device as set forth in Claim 1, wherein said control means comprises:

a plurality of digital switches for respectively setting cutting depths corresponding respectively to various ranges of diameters which said grinding wheel has throughout a useful life thereof, each of said cutting depths being determined in such a manner that a smaller grinding wheel is dressed through a larger cutting depth; and selection and control means responsive to the output from said detection means for selecting one of said cutting depths set in said digital switches and for controlling said feed means so as to infeed said dressing tool against said grinding wheel through said selected one of said cutting depths.

3. A dressing device as set forth in Claim 2, wherein said detection means comprises:

a plurality of dogs;

a plurality of limit switches each actuatable by a corresponding one of said dogs; and a shifting mechanism operatively connected with said feed means for moving said dogs relative to said limit switches in connection with the infeed movement of said tool support.

4. A dressing device as set forth in Claim 3, wherein:

said tool support carrying said dressing tool is mounted on said wheel head which is movable toward and away from said workpiece.

* * * * *